US006666042B1

(12) United States Patent
Cline et al.

(10) Patent No.: US 6,666,042 B1
(45) Date of Patent: Dec. 23, 2003

(54) SEQUENCING OF VARIABLE PRIMARY FLOW CHILLER SYSTEM

(75) Inventors: Lee R. Cline, West Salem, WI (US); Michael C. A. Schwedler, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/188,562

(22) Filed: Jul. 1, 2002

(51) Int. Cl.[7] ..... F25D 17/02; F25B 7/00
(52) U.S. Cl. ..... 62/175; 62/201
(58) Field of Search ..... 62/175, 201, 333, 62/335, 99, 185, 430

(56) References Cited

U.S. PATENT DOCUMENTS

| | | | | |
|---|---|---|---|---|
| 4,210,957 A | | 7/1980 | Spethmann | |
| 4,463,574 A | | 8/1984 | Spethmann et al. | |
| 4,483,152 A | | 11/1984 | Bitondo | |
| 4,679,404 A | | 7/1987 | Alsenz | |
| 4,817,395 A | * | 4/1989 | Martinez, Jr. | 62/175 |
| 4,926,649 A | * | 5/1990 | Martinez, Jr. | 62/99 |
| 5,195,329 A | * | 3/1993 | Lewis et al. | 62/117 |
| 5,222,370 A | | 6/1993 | James | |
| 5,301,513 A | | 4/1994 | Duff et al. | |
| 5,309,727 A | | 5/1994 | Duff et al. | |
| 5,327,742 A | * | 7/1994 | Duff et al. | 62/175 |
| 5,425,503 A | * | 6/1995 | Corso | 237/63 |
| 5,600,960 A | | 2/1997 | Schwedler et al. | |
| 5,687,579 A | * | 11/1997 | Vaynberg | 62/175 |
| 5,946,926 A | | 9/1999 | Hartman | |
| 6,085,532 A | * | 7/2000 | Sibik | 62/179 |
| 6,185,946 B1 | | 2/2001 | Hartman | |
| 6,257,007 B1 | | 7/2001 | Hartman | |
| 6,276,152 B1 | * | 8/2001 | Sibik | 62/201 |

OTHER PUBLICATIONS

Trane Engineers Newsletter, "Variable–Primary–Flow Systems", vol. 28, No. 3, 1999.

* cited by examiner

*Primary Examiner*—Marc Norman
(74) *Attorney, Agent, or Firm*—William J. Beres; William O'Driscoll

(57) ABSTRACT

To provide chilled water, a variable-primary-flow system includes two variable speed pumps that pump water through a first chiller and a second chiller. A control energizes the second chiller in response to a cooling demand exceeding that what can be met by the first chiller operating alone, and de-energizes the second chiller upon the cooling demand decreasing to a level below the first chiller's maximum capacity. When both chillers are operating, the capacities of the chillers are modulated in unison to meet the cooling demand. Likewise, when both pumps are running, their speed is modulated in unison to provide a desired pressure.

28 Claims, 2 Drawing Sheets

SEQUENCING OF VARIABLE PRIMARY FLOW CHILLER SYSTEM

BACKGROUND OF THE INVENTION

1. Field of the Invention

The present invention relates to chilled water systems that include variable flow pumps for circulating the chilled water through multiple chillers. More specifically, the present invention relates to a method of controlling such a system.

2. Description of Related Art

A chiller is an assembly of refrigerant components arranged in a circuit for cooling water. The chilled water is typically pumped to a number of remote heat exchangers or system coils for cooling various rooms or areas within a building.

In some cases, the water may be cooled by a chiller system comprising two or more chillers. When the cooling demand is low, only one chiller of the system may need to operate, and the operating chiller's capacity may be controlled to match the demand. The cooling demand is often determined by sensing the temperature of the chilled water discharged from the chiller system and comparing the sensed temperature to a predetermined target temperature. If the cooling demand is beyond a single chiller's maximum capacity, one or more additional chillers may need to be energized. Then, the operating chillers are controlled so the system's total capacity (sum of the chillers' individual capacities) meets the cooling demand.

Meanwhile, the chilled water is pumped at a flow rate that is adequate for each individual chiller and is delivered at a pressure sufficient to meet the needs of the system coils. This can be accomplished by pumping the chilled water with variable speed pumps and/or controlling a bypass valve to convey a portion of the discharged chilled water back to the suction side of the pumps.

Overall, controlling a chiller system can become quite involved. This is due to the difficulty of coordinating the control of several diverse chiller components, such as multiple chillers of varying capacity, multiple variable speed pumps, and a bypass valve. Moreover, the system components must operate to satisfy various needs, such as meeting the cooling demand, providing sufficient water pressure for the system coils, and providing adequate water flow through the chillers. A need to minimize the power consumption of the chillers and the chilled water pumps further complicates the controls of chiller systems. Although controls of such systems do exist, their actual control schemes may limit their use or effectiveness in certain applications, and their complexity may make them difficult to understand, install and service. Since many chiller installations have unique system requirements, there is a need for a more adaptable, straightforward control scheme for controlling chiller systems with variable speed chilled water pumps.

SUMMARY OF THE INVENTION

It is an object of the present invention to coordinate the operation of multiple chillers, multiple variable speed pumps, and a bypass valve to meet a cooling demand.

Another object of some embodiments of the invention is to energize a second chiller in response to a cooling demand exceeding that what can be met by a first chiller, and de-energizing the second chiller upon the cooling demand decreasing to a level below the first chiller's maximum capacity.

Another object of some embodiments is to operate two chillers in unison, whereby the chillers operate at the same capacity with respect to a percentage of their maximum capacity.

Another object of some embodiments is to operate two pumps at the same speed, but vary their speed to achieve a certain discharge pressure or pressure differential.

Another object, for a chiller system having two variable speed water pumps, is to maintain sufficient water flow through two chillers by opening a bypass valve that is in parallel flow relationship with the chillers.

Another object of some embodiments is to vary the speed of two pumps in response to sensing a pressure differential across a remote heat exchanger coil.

One or more of these objects are provided by a chiller system that includes two variable speed pumps that pump water through a first chiller and a second chiller for cooling the water. A control energizes the second chiller in response to a cooling demand exceeding that what can be met by the first chiller operating alone, and de-energizes the second chiller upon the cooling demand decreasing to a level below the first chiller's maximum capacity.

The present invention provides a method of controlling a chiller system that includes a first chiller and a second chiller through which water can be pumped to meet a cooling demand. The method comprises: pumping the water through the first chiller at a first flow rate to meet the cooling demand; increasing the cooling demand; in response to increasing the cooling demand, pumping the water through the first chiller at a second flow rate that is less than the first flow rate; and in response to increasing the cooling demand, pumping the water through the second chiller at a third flow rate, wherein the first flow rate is substantially equal to a sum of the second flow rate plus the third flow rate. The present invention also provides, with respect to the water, piping the first chiller and the second chiller in parallel flow relationship with a heat exchanger that is spaced apart from the first chiller and the second chiller, whereby the water is conveyed to the heat exchanger via a supply line and is conveyed from the heat exchanger via a return line; sensing a water pressure differential between the supply line and the return line; and controlling the first flow rate, the second flow rate and the third flow rate in response to sensing the water pressure differential.

The present invention further provides a method of controlling a chiller system that includes a first chiller and a second chiller for meeting a demand for chilled water, wherein the first chiller is selectively operable at a first full load and a first range of partial loads, and the second chiller is selectively operable at a second full load and a second range of partial loads. The chiller system further includes a chilled water circuit, a first pump for forcing the chilled water through the first chiller at a first flow rate that may vary, a second pump for forcing the chilled water through the second chiller at a second flow rate that may vary, a bypass valve, a first heat exchanger, and a second heat exchanger. The chilled water circuit connects the first chiller, the second chiller, the bypass valve, the first heat exchanger, and the second heat exchanger in parallel flow relationship with respect to the flow of chilled water. The method comprises increasing the demand for chilled water; in response to increasing the demand for chilled water, changing the operation of the first chiller from operating at the first full load to operating within the first range of partial loads; in response to increasing the demand for chilled water, reducing the first rate at which the first pump forces chilled water through the first chiller; and in response to increasing the demand for chilled water, energizing the second chiller to begin operating the second chiller in the second range of partial loads. The present invention yet further provides, via a supply line of the chilled water circuit, conveying the chilled water to the first heat exchanger and the second heat exchanger; via a return line of the chilled water circuit, conveying the chilled water from the first heat exchanger and the second heat exchanger; sensing a water pressure differential between the supply line and the return line; and varying the first flow rate and the second flow rate in response to sensing the water pressure differential.

The present invention still further provides a method of controlling a chiller system that includes a first chiller and a second chiller for meeting a demand for chilled water. The first chiller is selectively operable at a first full load and a first range of partial loads, and the second chiller is selectively operable at a second full load and a second range of partial loads. The chiller system further includes a chilled water circuit, a first pump for forcing the chilled water through the first chiller at a first flow rate that may vary, a second pump for forcing the chilled water through the second chiller at a second flow rate that may vary, a bypass valve, a first heat exchanger, and a second heat exchanger. The chilled water circuit connects the first chiller, the second chiller, the bypass valve, the first heat exchanger, and the second heat exchanger in parallel flow relationship with respect to the flow of chilled water. The method comprises establishing a chilled water temperature target; establishing a chilled water pressure target; selectively operating the chiller system in a high demand mode and a low demand mode to meet the chilled water temperature target; in the low demand mode, leaving the second chiller inactive while selectively operating the first chiller in the full load and the first range of partial loads to meet the chilled water temperature target; in the low demand mode, leaving the second pump inactive while modulating the pressure of the chilled water by controlling the operation of the first pump to meet the chilled water pressure target; in the high demand mode, operating the first chiller at a first partial load while operating the second chiller at a second partial load; and in the high demand mode, modulating the pressure of the chilled water by controlling the operation of the first pump and the second pump to meet the chilled water pressure target.

The present invention additionally provides a method of controlling a chiller system that includes a first chiller and a second chiller for meeting a demand for chilled water. The first chiller is selectively operable at a first full load and a percent of the first full load ranging from zero to one hundred percent, and the second chiller is selectively operable at a second full load and a percent of the second full load ranging from zero to one hundred percent. The chiller system further includes a chilled water circuit, a first pump for forcing the chilled water through the first chiller at a first flow rate that may vary, a second pump for forcing the chilled water through the second chiller at a second flow rate that may vary, a bypass valve, a first heat exchanger, and a second heat exchanger. The chilled water circuit connects the first chiller, the second chiller, the bypass valve, the first heat exchanger, and the second heat exchanger in parallel flow relationship with respect to the flow of chilled water. The method comprises establishing a chilled water temperature target; establishing a chilled water pressure target; selectively operating the chiller system in a high demand mode and a low demand mode to meet the chilled water temperature target; in the low demand mode, leaving the second chiller inactive while operating the first chiller to meet the chilled water temperature target; in the low demand mode, leaving the second pump inactive while modulating the pressure of the chilled water by controlling the operation of the first pump to meet the chilled water pressure target; in the low demand mode, modulating the pressure of the chilled water by controlling the operation of the first pump and the second pump to meet the chilled water pressure target; in the high demand mode, modulating the first chiller at a percentage of the first full load; and in the high demand mode, modulating the second chiller at a percentage of the second full load and in unison with the first chiller, whereby the percentage of the first full load is substantially equal to the percentage of the second full load.

The present invention moreover provides a chiller system. The system comprises a first chiller wherein the first chiller is selectively operable at a first full load and a first range of partial loads; and a second chiller for meeting a demand for chilled water wherein the second chiller is selectively operable at a second full load and a second range of partial loads. The system also comprises a first pump for forcing the chilled water through the first chiller at a first flow rate that may vary, a second pump for forcing the chilled water through the second chiller at a second flow rate that may vary; a bypass valve; a first heat exchanger; a second heat exchanger; and a chilled water circuit. The chilled water circuit connects the first chiller, the second chiller, the bypass valve, the first heat exchanger, and the second heat exchanger in parallel flow relationship with respect to the flow of chilled water; control circuitry or logic establishing a chilled water temperature target; control circuitry or logic establishing a chilled water pressure target; control circuitry or logic selectively operating the chiller system in a high demand mode and a low demand mode to meet the chilled water temperature target. The system further comprises, in the low demand mode, leaving the second chiller inactive while selectively operating the first chiller in the full load and the first range of partial loads to meet the chilled water temperature target; control circuitry or logic, in the low demand mode, leaving the second pump inactive while modulating the pressure of the chilled water by controlling the operation of the first pump to meet the chilled water pressure target; control circuitry or logic, in the high demand mode, operating the first chiller at a first partial load while operating the second chiller at a second partial load; and control circuitry or logic, in the high demand mode, modulating the pressure of the chilled water by controlling the operation of the first pump and the second pump to meet the chilled water pressure target.

The present invention still further provides a chiller system. The system includes a first chiller where the first chiller is selectively operable at a first full load and a percent of the first full load ranging from zero to one hundred percent; a second chiller for meeting a demand for chilled water where the second chiller is selectively operable at a second full load and a percent of the second full load ranging from zero to one hundred percent; a first pump for forcing the chilled water through the first chiller at a first flow rate that may vary; and a second pump for forcing the chilled water through the second chiller at a second flow rate that may vary. The system also includes a bypass valve; a first heat exchanger; a second heat exchanger; and a chilled water circuit wherein the chilled water circuit connects the is first chiller, the second chiller, the bypass valve, the first heat exchanger, and the second heat exchanger in parallel flow relationship with respect to the flow of chilled water. The system also includes a controller establishing a chilled water temperature target and a chilled water pressure target, the controller selectively operating the chiller system in a high demand mode and a low demand mode to meet the chilled water temperature target. In the low demand mode, the controller leaves the second chiller inactive while operating the first chiller to meet the chilled water temperature target; in the low demand mode, the controller leaves the second pump inactive while modulating the pressure of the chilled water by controlling the operation of the first pump to meet the chilled water pressure target; in the low demand mode, the controller modulates the pressure of the chilled water by controlling the operation of the first pump and the second pump to meet the chilled water pressure target; in the high demand mode, the controller modulates the first chiller at a percentage of the first full load; and in the high demand mode, the controller modulates the second chiller at a percentage of the second full load and in unison with the first chiller. The percentage of the first full load is substantially equal to the percentage of the second full load.

DESCRIPTION OF THE DRAWING FIGURES

DESCRIPTION OF THE PREFERRED EMBODIMENT

Figure 1:
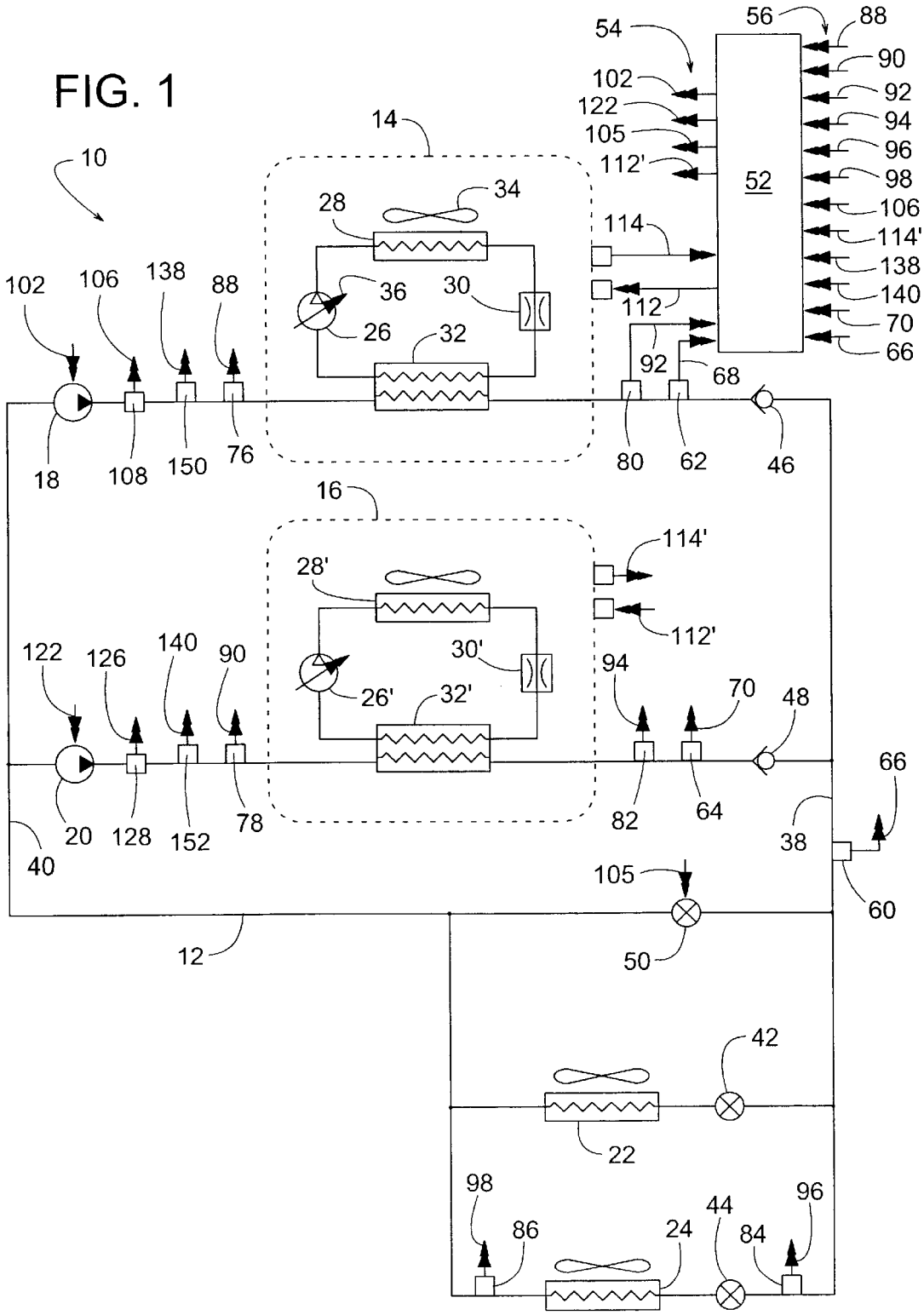
FIG. 1 is a schematic diagram of a chiller system according to one embodiment of the invention.

A chiller system 10, shown in FIG. 1, includes multiple chillers for generating chilled water. The term, "chiller" refers to any apparatus having a refrigerant cycle for creating a cooling effect. Multiple pumps force the water through the chillers, and a chilled water circuit 12 distributes the chilled water to various system coils or heat exchangers for cooling rooms or other areas within a building. Although system 10 may include any number of chillers and pumps, for illustration, system 10 will be described as having two chillers 14 and 16, two pumps 18 and 20, and two coils 22 and 24.

Chillers 14 and 16 are schematically illustrated to represent all types of chillers. In one embodiment of the invention, chiller 14 includes a compressor 26 that forces a refrigerant in series through a condenser 28, an expansion device 30 (e.g., flow restrictor, orifice, capillary, expansion valve, etc.), and an evaporator 32. With the aid of a condenser fan 34 (or some other system for promoting the transfer of heat), condenser 28 releases waste heat from relatively hot compressed refrigerant inside condenser 28. From condenser 28, the refrigerant expands and its temperature drops upon passing through expansion device 30. The cooler refrigerant then passes through evaporator 32 to cool the water that pump 18 forces through evaporator 32. After cooling the water, the refrigerant returns to the suction side of compressor 26 to perpetuate the refrigerant cycle.

Chiller 14 is preferably provided with a device that can adjust the refrigerant's flow rate for varying the chiller's capacity or cooling effect. Common examples of such a device include, but are not limited to, adjustable inlet guide vanes of a centrifugal compressor, a slide valve of a screw compressor, and a compressor driven by a variable speed motor. All of these examples and more are schematically represented by arrow 36.

In some embodiments of the invention, chillers 14 and 16 are similar in that chiller 16 includes a compressor 26', a condenser 28', an expansion device 30' and an evaporator 32'. However, one chiller may have a higher maximum cooling capacity than the other.

Chillers 14 and 16 may be installed in the same general location (e.g., basement or roof of the building), and system coils 22 and 24 may be installed where they are closer to the areas they cool. To connect the chillers to the coils, chilled water circuit 12 includes a supply line 38 and a return line 40. Supply line 38 conveys chilled water from chillers 14 and 16 to coils 22 and 24. From supply line 38, the chilled water passes through coils 22 and 24 to cool air that a fan forces across the coils to cool the building. Valves 42 and 44 can throttle the flow of chilled water to a coil, thereby providing a way to individually control or limit the amount of cooling for a particular area of the building. After the water passes through the coils, the return line 40 conveys the water back to the inlet side of pumps 18 and 20.

To inhibit backflow through the chillers, circuit 12 may include two check valves 46 and 48. When only one chiller/pump is operating, one of the check valves prevents the water from flowing backwards through the inactive chiller/pump. For example, if chiller 14 and pump 18 are operating while chiller 16 and pump 20 are inactive, check valve 48 prevents water in supply line 38 from flowing backwards in series through evaporator 32', pump 20 and into return line 40. Likewise, check valve 46 prevents water from flowing backwards through evaporator 32 when pump 20 is operating and pump 18 is inactive.

In some situations, such as during periods of very low cooling demand, valves 42 and 44 may throttle the water flow to such an extent that the total flow rate is inadequate for chiller 14 or 16. If the flow rate through an operating chiller becomes too low, the water might freeze inside the chiller. To avoid this, a bypass valve 50 may be partially or fully opened to create a shunt that can convey at least a portion of the water from supply line 38 directly to return line 40 without all the water having to first pass though valves 42 and 44.

To provide chilled water at a proper temperature and pressure, system 10 includes a controller 52. Controller 52 is schematically illustrated to encompass a wide variety of electrical devices (programmable or not programmable) having the ability to provide various output signals 54 in response to various input signals 56. Examples of controller 52 include, but are not limited to, microcomputers, personal computers, dedicated electrical circuits having analog and/or digital components, programmable logic controllers, and various combinations thereof.

Figure 2:
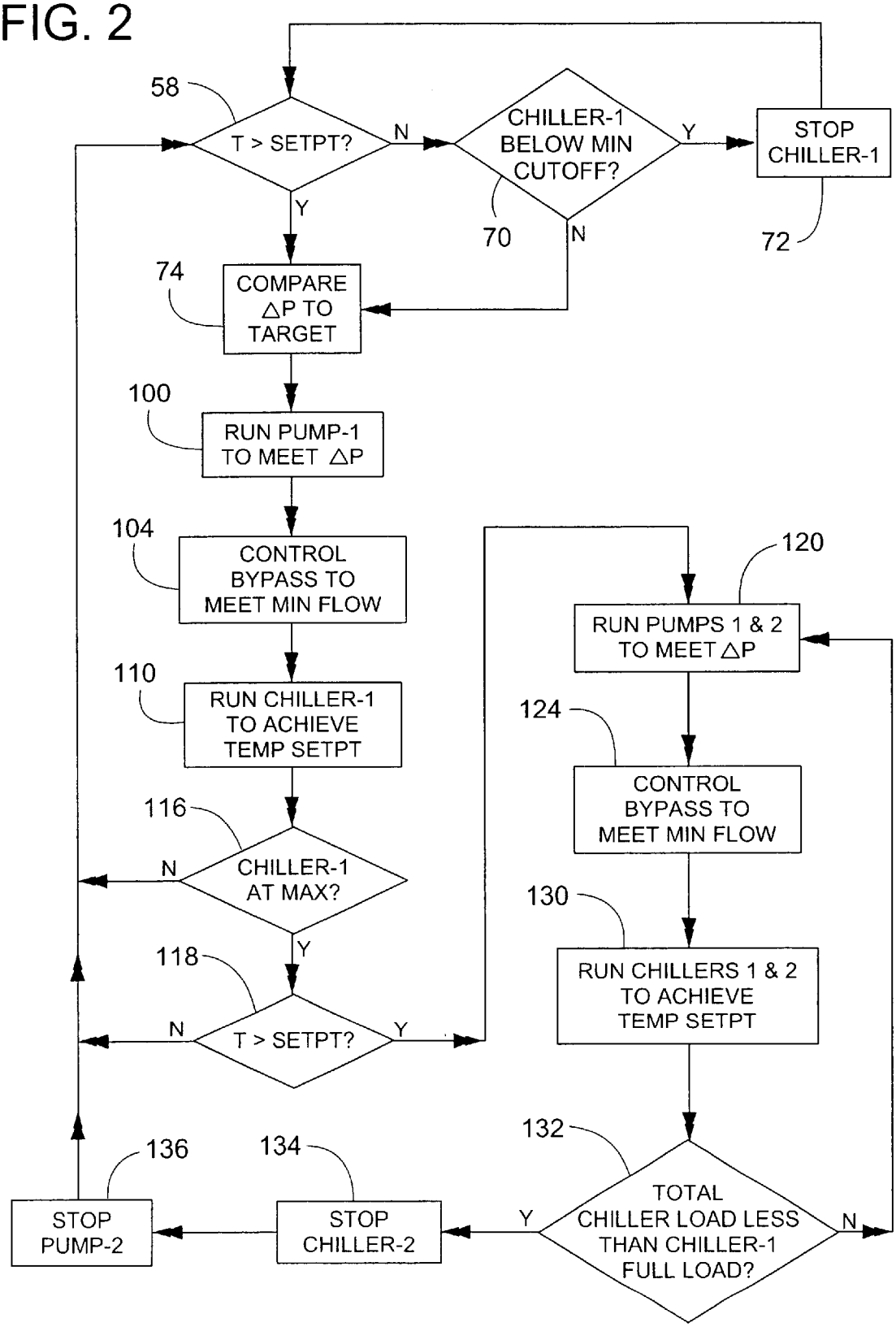
FIG. 2 is a flow chart illustrating a control scheme for the chiller system of FIG. 1.

In some embodiments of the invention, controller 52 controls chiller system 10 according to the flow chart of FIG. 2. In decision block 58, controller 52 compares the actual chilled water temperature to an established chilled water temperature target or set point. Controller 52 can determine the actual chilled water temperature from a temperature sensor 60 on supply line 38 and/or individual temperature sensors 62 and 64 (associated with chillers 14 and 16, respectively). Controller 52 may receive temperature-indicating signals 66, 68 and 70 from temperature sensors 60, 62 and 64, respectively. Establishing the chilled water temperature target can be performed through a conventional input device, such as a keyboard, dial, etc.

If block 58 determines that the actual chilled water temperature is less than or equal to the set point, control decision block 70 determines whether chiller 14 should continue operating (provided it was already operating). If chiller 14 is operating below its predetermined minimum capacity, control block 72 deactivates chiller 14, and control returns to decision block 58. Otherwise, control shifts to control block 74, which compares an actual chilled water pressure to an established chilled water pressure target.

Establishing the chilled water pressure target can be a performed at any time before or after the installation of system 10 and may be performed through a conventional input device, such as a keyboard, dial, etc. Controller 52 can determine the actual chilled water pressure from a pressure sensor 76 (sensing pressure of water entering chiller 14), a pressure sensor 78 (sensing pressure of water entering chiller 16), a pressure sensor 80 (sensing the pressure of water leaving chiller 14), a pressure sensor 82 (sensing the pressure of water leaving chiller 16), a pressure sensor 84 (sensing the pressure of water in supply line 38, near coil 24), and/or a pressure sensor 86 (sensing the pressure of water in return line 40, near coil 24). The actual chilled water pressure value can be a single pressure reading or a pressure differential between two pressure readings. Controller 52 may receive pressure-indicating signals 88, 90, 92, 94, 96 and 98 from pressure sensors 76, 78, 80, 82, 84 and 86, respectively.

In a currently preferred embodiment, block 74 compares the chilled water pressure target (e.g., a delta-P value) to a pressure differential (signal 96 minus signal 98) across the system coil (e.g., coil 24) that is furthest from the chillers. In response to the comparison in block 74, block 100 directs controller 52 to provide an output signal 102 that causes pump 18 to create a pressure differential across coil 24 that meets the target value. Controlling a pump to modulate pressure is well known to those skilled in the art. For example, pump 18 can be driven by a variable speed motor whose inverter or other control circuitry is responsive to signal 102.

In block 104, control 52 varies the opening of bypass valve 50 via a signal 105 if the water flow through chiller 14 is too low. Controller 52 can determine the flow rate by receiving a flow rate input signal 106 from a flow sensor 108. Alternatively, the flow rate can be determined by comparing known flow characteristics of evaporator 32 to the pressure drop across the evaporator (the difference between pressure signals 92 and 88).

In block 110, controller 52 provides one or more output signals 112 that vary the capacity or otherwise control chiller 14 in an attempt to meet the cooling demand with chiller 16 inactive. With only one chiller operating, system 10 is considered as operating in a low demand mode. Controller 52 generates output signal 112 in response to the chilled water temperature signal 66, chilled water temperature signal 62, and/or signal 114, wherein signal 114 represents various common feedback from the operation of chiller 14. In this example, output signal 112 represents one or more signals for varying the opening of inlet guide vanes and varying the speed of compressor 26, thereby operating chiller 14 over a range of partial loads between zero and one hundred percent of the chiller's full load. Such control of a single chiller to meet a cooling demand can be accomplished by any of the numerous control functions well known to those skilled in the art.

Periodically, decision block 116 determines whether chiller 14 is operating at its rated full load. If not, control of system 10 continues as just described. However, if chiller 14 is at full load, another decision block 118 determines whether chiller 14 is able to maintain the chilled water temperature at or below its target temperature. If chiller 14 operating at full load is sufficient to meet the cooling demand, control returns to block 58 whose function has already been defined.

Referring back to block 118, if chiller 14 is unable to meet the cooling demand, control shifts to block 120 to change the operation of system 10 to a high demand mode. In the high demand mode, block 120 directs controller 52 to provide an output signal 122 that activates pump 20. Controller 52 now modulates both pumps 18 and 20 to create a pressure differential across coil 24 that meets the water pressure target. Upon switching from the low demand mode to the high demand mode, signal 102 will reduce the speed of pump 18, since two pumps are now running instead of just one. Ideally, the flow rate through pump 18 operating alone during the low demand mode will be about equal to the combined flow rates through pumps 18 and 20 during the high demand mode. In the high demand mode, the speed modulation of both pumps can be simplified by controlling their speed in unison, whereby both pumps are controlled to run at the same speed or at the same percentage of their rated full speed.

In block 124, controller 52 varies the opening of bypass valve 50 if the water flow through either chiller 14 or 16 is too low. Similar to what was done with chiller 14, controller 52 can determine the flow rate through evaporator 32' by receiving a flow rate input signal 126 from a flow sensor 128. Alternatively, the flow rate through chiller 16 can be determined by comparing known flow characteristics of evaporator 32' to the pressure drop across the evaporator (the difference between pressure signals 94 and 90).

In block 130, controller 52 provides output signals 112 and 112' to vary the capacity or otherwise control chillers 14 and 16, respectively. With both chillers operating, system 10 is considered as operating in the high demand mode for meeting generally higher cooling demands. Controller 52 generates output signals 112 and 112' in response to one or more feedback signals, such as chiller water temperature signals 66, 68 and 70 and/or signals 114 and 114'. Signals 114 and 114' are similar in that they both represent various common feedbacks from the operation of their respective chiller. In this example, output signal 112' represents one or more signals for varying the opening of inlet guide vanes and varying the speed of compressor 26', thereby operating chiller 16 over a range of partial loads between zero and one hundred percent of the chiller's full load. In the high demand mode, the capacity of chillers 14 and 16 are preferably modulated in unison, whereby both chillers operate at the same percentage of their respective full load rating. For example, at times, both chillers operate at 50% of their full load, and other times they both chillers operate at 75% of their full load. This can be done even when one chiller has a significantly higher full load capacity than the other.

Periodically, a decision block 132 determines whether system 10 can return to operating in the low demand mode. This is done by considering the combined partial loads of both chillers 14 and 16 and comparing that to the rated full load of chiller 14. If the rated full load of chiller 14 is appreciably greater than the combined partial loads of both chillers, control block 134 will deactivate chiller 16, and block 136 will stop pump 20, thereby returning system 10 to its low demand mode of operation. Otherwise, control returns to block 120, and system 10 continues operating in the high demand mode.

When a chiller is operating at less than full load, the chiller's partial load can be determined in various ways that are well known to those skilled in the art. For example, the electrical current to the motor that drives the compressor can be measured (e.g., signal 114 or 114'), and the chiller's percent of full load can be approximated as a ratio of the motor's current draw at part load to the motor's current draw at full load. Alternatively, a chiller's load can be defined as a product of the flow rate of chilled water passing through the chiller's evaporator (e.g., signal 106 or 126) times the chilled water's temperature drop upon passing through the evaporator. Such a temperature drop can be determined by installing temperature sensors 150 and 152, which provide signals 138 and 140 that indicate the temperature of the water entering evaporators 32 and 32' respectively. The temperature drop will then be the value of signal 68 minus the value of signal 138 for evaporator 32, or the value of signal 70 minus the value of signal 140 for evaporator 32'. Sensing the position of a compressor's inlet guide vanes, the position of a compressor's slide valve, and/or a compressor's speed are other ways of determining a chiller's operating load.

Although the invention is described with reference to a preferred embodiment, it should be appreciated by those skilled in the art that other variations are well within the scope of the invention. Therefore, the scope of the invention is to be determined by reference to the claims, which follow.

We claim:

1. A method of controlling a chiller system that includes a first chiller and a second chiller through which water can be pumped to meet a cooling demand, comprising:

pumping the water through the first chiller at a first flow rate to meet the cooling demand;

increasing the cooling demand;

in response to increasing the cooling demand, pumping the water through the first chiller at a second flow rate that is less than the first flow rate;

in response to increasing the cooling demand, pumping the water through the second chiller at a third flow rate, wherein the first flow rate is substantially equal to a sum of the second flow rate plus the third flow rate;

with respect to the water, piping the first chiller and the second chiller in parallel flow relationship with a heat exchanger that is spaced apart from the first chiller and the second chiller, whereby the water is conveyed to the heat exchanger via a supply line and is conveyed from the heat exchanger via a return line;

sensing a water pressure differential between the supply line and the return line; and controlling the first flow rate, the second flow rate and the third flow rate in response to sensing the water pressure differential.

2. A method of controlling a chiller system that includes a first chiller and a second chiller through which water can be pumped to meet a cooling demand, comprising:

pumping the water through the first chiller at a first flow rate to meet the cooling demand;

increasing the cooling demand;

in response to increasing the cooling demand, pumping the water through the first chiller at a second flow rate that is less than the first flow rate;

in response to increasing the cooling demand, pumping the water through the second chiller at a third flow rate, wherein the first flow rate is substantially equal to a sum of the second flow rate plus the third flow rate;

with respect to the water, piping the first chiller and the second chiller in parallel flow relationship with a bypass valve;

determining whether the first flow rate, the second flow rate, and the third flow decreases to a predetermined minimum flow rate; and opening the bypass valve in response to at least one of the first flow rate, the second flow rate, and the third flow decreasing to the predetermined minimum flow rate.

3. The method of claim 2, further comprising sensing a water pressure drop across t east one of the first chiller and the second chiller to determine whether the first flow rate, the second flow rate, and the third flow has decreased to the predetermined minimum flow rate.

4. A method of controlling a chiller system that includes a first chiller and a second chiller for meeting a demand for chilled water, wherein the first chiller is selectively operable at a first full load and a first range of partial loads, and the second chiller is selectively operable at a second full load and a second range of partial loads, wherein the chiller system further includes a chilled water circuit, a first pump for forcing the chilled water through the first chiller at a first flow rate that may vary, a second pump for forcing the chilled water through the second chiller at a second flow rate that may vary, a bypass valve, a first heat exchanger, and a second heat exchanger, wherein the chilled water circuit connects the first chiller, the second chiller, the bypass valve, the first heat exchanger, and the second heat exchanger in parallel flow relationship with respect to the flow of chilled water, the method comprising:

increasing the demand for chilled water;

in response to increasing the demand for chilled water, changing the operation of the first chiller from operating at the first full load to operating within the first range of partial loads;

in response to increasing the demand for chilled water, reducing the first rate at which the first pump forces chilled water through the first chiller; and in response to increasing the demand for chilled water, energizing the second chiller to begin operating the second chiller in the second range of partial loads.

5. The method of claim 4, further comprising:

via a supply line of the chilled water circuit, conveying the chilled water to the first heat exchanger and the second heat exchanger;

via a return line of the chilled water circuit, conveying the chilled water from the first heat exchanger and the second heat exchanger;

sensing a water pressure differential between the supply line and the return line; and varying the first flow rate and the second flow rate in response to sensing the water pressure differential.

6. The method of claim 5, further comprising:

with respect to chilled water flowing through the supply line, installing the second heat exchanger further downstream than the first heat exchanger; and sensing the water pressure differential at a location that is closer to the second heat exchanger than the first heat exchanger.

7. The method of claim 4, further comprising:

determining whether at least one of the first flow rate and the second flow rate decreases to a predetermined minimum flow rate; and opening the bypass valve in response to at least one of the first flow rate and the second flow rate decreasing to the predetermined minimum flow rate.

8. The method of claim 7, further comprising sensing a water pressure drop across at least one of the first chiller and the second chiller to determine whether the first flow rate and the second flow rate has decreased to the predetermined minimum flow rate.

9. The method of claim 4, further comprising:

via a supply line of the chilled water circuit, conveying the chilled water to the first heat exchanger and the second heat exchanger; and determining the demand for chilled water by sensing a temperature of the chilled water in the supply line.

10. The method of claim 4, further comprising:

operating the first chiller at a first partial load;

operating the second chiller at a second partial load; and deactivating the second chiller when the sum of the first partial load plus the second partial load is less than the first full load.

11. The method of claim 4, further comprising: at times, running the first pump and the second pump at varying speed and in unison, whereby the speed of the first pump and the speed of the second pump are substantially equal.

12. A method of controlling a chiller system that includes a first chiller and a second chiller for meeting a demand for chilled water, wherein the first chiller is selectively operable at a first full load and a first range of partial loads, and the second chiller is selectively operable at a second full load and a second range of partial loads, wherein the chiller system further includes a chilled water circuit, a first pump for forcing the chilled water through the first chiller at a first flow rate that may vary, a second pump for forcing the chilled water through the second chiller at a second flow rate that may vary, a bypass valve, a first heat exchanger, and a second heat exchanger, wherein the chilled water circuit connects the first chiller, the second chiller, the bypass valve, the first heat exchanger, and the second heat exchanger in parallel flow relationship with respect to the flow of chilled water, the method comprising:

establishing a chilled water temperature target;

establishing a chilled water pressure target;

selectively operating the chiller system in a high demand mode and a low demand mode to meet the chilled water temperature target;

in the low demand mode, leaving the second chiller inactive while selectively operating the first chiller in the full load and the first range of partial loads to meet the chilled water temperature target;

in the low demand mode, leaving the second pump inactive while modulating the pressure of the chilled water by controlling the operation of the first pump to meet the chilled water pressure target;

in the high demand mode, operating the first chiller at a first partial load while operating the second chiller at a second partial load; and in the high demand mode, modulating the pressure of the chilled water by controlling the operation of the first pump and the second pump to meet the chilled water pressure target.

13. The method of claim 12, further comprising:

via a supply line of the chilled water circuit, conveying the chilled water to the first heat exchanger and the second heat exchanger;

via a return line of the chilled water circuit, conveying the chilled water from the first heat exchanger and the second heat exchanger;

sensing a water pressure differential between the supply line and the return line, wherein the chilled water pressure target is a predetermined value of the water pressure differential.

14. The method of claim 13, further comprising:

with respect to chilled water flowing through the supply line, installing the second heat exchanger further downstream than the first heat exchanger; and sensing the water pressure differential at a location that is closer to the second heat exchanger than the first heat exchanger.

15. The method of claim 12, further comprising:

determining whether at least one of the first flow rate and the second flow rate decreases to a predetermined minimum flow rate; and opening the bypass valve in response to at least one of the first flow rate and the second flow rate decreasing to the predetermined minimum flow rate.

16. The method of claim 15, further comprising sensing a water pressure drop across at least one of the first chiller and the second chiller to determine whether the first flow rate and the second flow rate has decreased to the predetermined minimum flow rate.

17. The method of claim 12, further comprising:

via a supply line of the chilled water circuit, conveying the chilled water to the first heat exchanger and the second heat exchanger; and determining the demand for chilled water by sensing a temperature of the chilled water in the supply line.

18. The method of claim 12, further comprising:

operating the first chiller at a first partial load;

operating the second chiller at a second partial load; and deactivating the second chiller when the sum of the first partial load plus the second partial load is less than the first full load.

19. The method of claim 12, further comprising: at times, running the first pump and the second pump at varying speed and in unison, whereby the speed of the first pump and the speed of the second pump are substantially equal.

20. A method of controlling a chiller system that includes a first chiller and a second chiller for meeting a demand for chilled water, wherein the first chiller is selectively operable at a first full load and a percent of the first full load ranging from zero to one hundred percent, and the second chiller is selectively operable at a second full load and a percent of the second full load ranging from zero to one hundred percent, wherein the chiller system further includes a chilled water circuit, a first pump for forcing the chilled water through the first chiller at a first flow rate that may vary, a second pump for forcing the chilled water through the second chiller at a second flow rate that may vary, a bypass valve, a first heat exchanger, and a second heat exchanger, wherein the chilled water circuit connects the first chiller, the second chiller, the bypass valve, the first heat exchanger, and the second heat exchanger in parallel flow relationship with respect to the flow of chilled water, the method comprising:

establishing a chilled water temperature target;

establishing a chilled water pressure target;

selectively operating the chiller system in a high demand mode and a low demand mode to meet the chilled water temperature target;

in the low demand mode, leaving the second chiller inactive while operating the first chiller to meet the chilled water temperature target;

in the low demand mode, leaving the second pump inactive while modulating the pressure of the chilled water by controlling the operation of the first pump to meet the chilled water pressure target;

in the low demand mode, modulating the pressure of the chilled water by controlling the operation of the first pump and the second pump to meet the chilled water pressure target;

in the high demand mode, modulating the first chiller at a percentage of the first full load; and in the high demand mode, modulating the second chiller at a percentage of the second full load and in unison with the first chiller, whereby the percentage of the first full load is substantially equal to the percentage of the second full load.

21. The method of claim 12, further comprising:

via a supply line of the chilled water circuit, conveying the chilled water to the first heat exchanger and the second heat exchanger;

via a return line of the chilled water circuit, conveying the chilled water from the first heat exchanger and the second heat exchanger;

sensing a water pressure differential between the supply line and the return line, wherein the chilled water pressure target is a predetermined value of the water pressure differential.

22. The method of claim 21, further comprising:

with respect to chilled water flowing through the supply line, installing the second heat exchanger further downstream than the first heat exchanger; and sensing the water pressure differential at a location that is closer to the second heat exchanger than the first heat exchanger.

23. The method of claim 20, further comprising:

determining whether at least one of the first flow rate and the second flow rate decreases to a predetermined minimum flow rate; and opening the bypass valve in response to at least one of the first flow rate and the second flow rate decreasing to the predetermined minimum flow rate.

24. The method of claim 23, further comprising sensing a water pressure drop across at least one of the first chiller and the second chiller to determine whether the first flow rate and the second flow rate has decreased to the predetermined minimum flow rate.

25. The method of claim 20, further comprising:

via a supply line of the chilled water circuit, conveying the chilled water to the first heat exchanger and the second heat exchanger; and determining the demand for chilled water by sensing a temperature of the chilled water in the supply line.

26. The method of claim 20, further comprising:

at times, running the first pump and the second pump at varying speed and in unison, whereby the speed of the first pump and the speed of the second pump are substantially equal.

27. A chiller system comprising:

a first chiller wherein the first chiller is selectively operable at a first full load and a first range of partial loads;

a second chiller for meeting a demand for chilled water, wherein the second chiller is selectively operable at a second full load and a second range of partial loads;

a first pump for forcing the chilled water through the first chiller at a first flow rate that may vary, a second pump for forcing the chilled water through the second chiller at a second flow rate that may vary;

a bypass valve;

a first heat exchanger;

a second heat exchanger;

a chilled water circuit, the chilled water circuit connects the first chiller, the second chiller, the bypass valve, the first heat exchanger, and the second heat exchanger in parallel flow relationship with respect to the flow of chilled water;

means for establishing a chilled water temperature target;

means for establishing a chilled water pressure target;

means for selectively operating the chiller system in a high demand mode and a low demand mode to meet the chilled water temperature target;

means for, in the low demand mode, leaving the second chiller inactive while selectively operating the first chiller in the full load and the first range of partial loads to meet the chilled water temperature target;

means for, in the low demand mode, leaving the second pump inactive while modulating the pressure of the chilled water by controlling the operation of the first pump to meet the chilled water pressure target;

means for, in the high demand mode, operating the first chiller at a first partial load while operating the second chiller at a second partial load; and means for, in the high demand mode, modulating the pressure of the chilled water by controlling the operation of the first pump and the second pump to meet the chilled water pressure target.

28. A chiller system comprising:

a first chiller wherein the first chiller is selectively operable at a first full load and a percent of the first full load ranging from zero to one hundred percent;

a second chiller for meeting a demand for chilled water, wherein the second chiller is selectively operable at a second full load and a percent of the second full load ranging from zero to one hundred percent;

a first pump for forcing the chilled water through the first chiller at a first flow rate that may vary;

a second pump for forcing the chilled water through the second chiller at a second flow rate that may vary;

a bypass valve;

a first heat exchanger;

a second heat exchanger;

a chilled water circuit wherein the chilled water circuit connects the first chiller, the second chiller, the bypass valve, the first heat exchanger, and the second heat exchanger in parallel flow relationship with respect to the flow of chilled water;

means for establishing a chilled water temperature target;

means for establishing a chilled water pressure target;

means for selectively operating the chiller system in a high demand mode and a low demand mode to meet the chilled water temperature target;

means for, in the low demand mode, leaving the second chiller inactive while operating the first chiller to meet the chilled water temperature target;

means for, in the low demand mode, leaving the second pump inactive while modulating the pressure of the chilled water by controlling the operation of the first pump to meet the chilled water pressure target;

means for, in the low demand mode, modulating the pressure of the chilled water by controlling the operation of the first pump and the second pump to meet the chilled water pressure target;

means for, in the high demand mode, modulating the first chiller at a percentage of the first full load; and means for, in the high demand mode, modulating the second chiller at a percentage of the second full load and in unison with the first chiller, whereby the percentage of the first full load is substantially equal to the percentage of the second full load.

* * * * *

UNITED STATES PATENT AND TRADEMARK OFFICE

CERTIFICATE OF CORRECTION

PATENT NO. : 6,666,042 B1
DATED : December 23, 2003
INVENTOR(S) : Lee R. Cline and Michael C.A. Schwedler It is certified that error appears in the above-identified patent and that said Letters Patent is hereby corrected as shown below:

Column 10,
Line 2, “t east” should read -- at least --.

Signed and Sealed this

Thirtieth Day of March, 2004

JON W. DUDAS
*Acting Director of the United States Patent and Trademark Office*